US011278925B2

(12) United States Patent
Beranger et al.

(10) Patent No.: US 11,278,925 B2
(45) Date of Patent: Mar. 22, 2022

(54) HEAD FOR DISPENSING A FLUID PRODUCT

(71) Applicant: APTAR FRANCE SAS, Le Neubourg (FR)

(72) Inventors: Stephane Beranger, Surtauville (FR); Frederic Duquet, Crespières (FR); Julien Sagliet, Franqueville Saint Pierre (FR)

(73) Assignee: APTAR FRANCE SAS, Le Neubourg (FR)

( * ) Notice: Subject to any disclaimer, the term of this patent is extended or adjusted under 35 U.S.C. 154(b) by 112 days.

(21) Appl. No.: 16/607,897

(22) PCT Filed: Apr. 24, 2018

(86) PCT No.: PCT/FR2018/051019
§ 371 (c)(1),
(2) Date: Oct. 24, 2019

(87) PCT Pub. No.: WO2018/197798
PCT Pub. Date: Nov. 1, 2018

(65) Prior Publication Data

US 2020/0114382 A1 Apr. 16, 2020

(30) Foreign Application Priority Data

Apr. 27, 2017 (FR) ..... 1753689
May 5, 2017 (FR) ..... 1754003

(51) Int. Cl.
*B05B 11/00* (2006.01)
*B05B 15/40* (2018.01)
*B05B 1/14* (2006.01)

(52) U.S. Cl.
CPC ..... *B05B 11/3097* (2013.01); *B05B 1/14* (2013.01); *B05B 15/40* (2018.02)

(58) Field of Classification Search
CPC ..... B05B 11/3097; B05B 15/40; B05B 1/14
(Continued)

(56) References Cited

U.S. PATENT DOCUMENTS 5,348,189 A 9/1994 Cater
2002/0130198 A1* 9/2002 Bennett ..... B05B 7/0037 239/333

(Continued)

FOREIGN PATENT DOCUMENTS

FR 2 903 328 A1 1/2008
FR 2 915 470 A1 10/2008

(Continued)

OTHER PUBLICATIONS

International Preliminary Report on Patentability issued from the International Bureau in International Application No. PCT/FR2018/051019, dated Jul. 30, 2019.

(Continued)

*Primary Examiner* — Steven J Ganey
(74) *Attorney, Agent, or Firm* — Sughrue Mion, PLLC

(57) ABSTRACT

A fluid dispenser head for mounting on a dispenser member, such as a pump, and including a bearing surface for actuating the dispenser member, and a spray wall that is perforated with a network of holes through which the fluid under pressure passes so as to be sprayed in small droplets, the dispenser head being characterized in that it further includes a suction chamber of volume that is variable, such that the volume of the suction chamber decreases when pressure is exerted on the bearing surface and increases when the pressure on the bearing surface is relaxed.

12 Claims, 3 Drawing Sheets

Figure 2A:
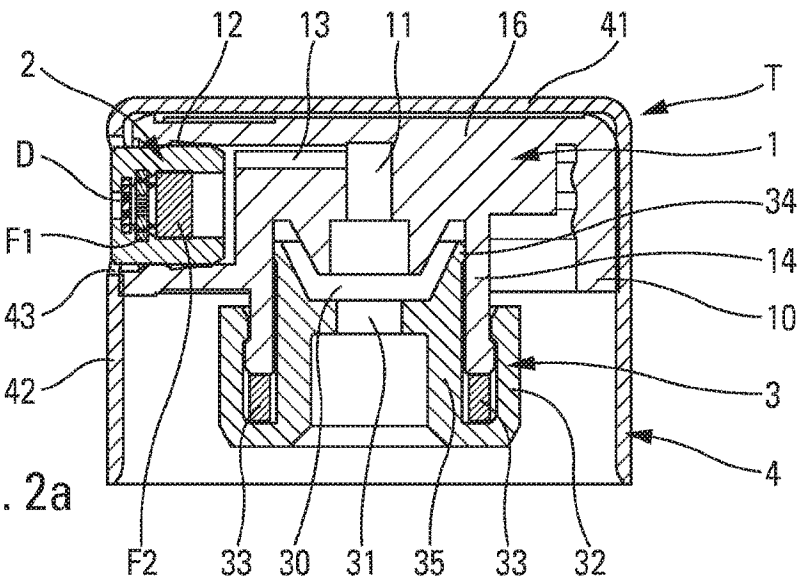

(58) Field of Classification Search
USPC ..... 239/333, 575, 590–590.5
See application file for complete search history.

(56) References Cited

U.S. PATENT DOCUMENTS

| | | | |
|---|---|---|---|
| 2009/0001099 | A1 | 1/2009 | Kennedy et al. |
| 2009/0302072 | A1 | 12/2009 | Lang et al. |
| 2011/0041844 | A1 | 2/2011 | Dunne |

FOREIGN PATENT DOCUMENTS

| | | | |
|---|---|---|---|
| WO | 95/31291 | A1 | 11/1995 |
| WO | 2013/125555 | A1 | 8/2013 |

OTHER PUBLICATIONS

International Search Report for PCT/FR2018/051019 dated Aug. 1, 2018 (PCT/ISA/210).

* cited by examiner

HEAD FOR DISPENSING A FLUID PRODUCT

CROSS REFERENCE TO RELATED APPLICATIONS

This application is a National Stage of International Application No. PCT/FR2018/051019 filed Apr. 24, 2018, claiming priority based on French Patent Application Nos. 1753689 filed Apr. 27, 2017 and U.S. Pat. No. 1,754,003 filed May 5, 2017.

The present invention relates to a fluid dispenser head for associating with a dispenser member, such as a pump or a valve. The head may be in the form of a pusher and may define a bearing surface on which the user may exert a thrust force so as to actuate the dispenser member. The dispenser head may be integrated in, or mounted on, the dispenser member. This type of fluid dispenser head is frequently used in the fields of perfumery, cosmetics, and pharmacy.

A conventional dispenser head, e.g. of the pusher type, comprises:

- a connection sleeve for connecting to an outlet of a dispenser member, such as a pump or a valve;
- an inlet well in line with the connection sleeve;
- an axial assembly housing in which there extends a pin defining a side wall and a front wall; and
- a cup-shaped nozzle comprising a substantially-cylindrical wall having an end that is closed by a spray wall that forms a spray orifice, the nozzle being assembled along an axis X in the axial assembly housing, with its cylindrical wall engaged around the pin, and its spray wall in axial abutment against the front wall of the pin.

Document FR 2 903 328 A1 describes several embodiments of a nozzle including a spray wall that is perforated with a plurality of spray holes that are substantially or completely identical in diameter, lying in the range about 1 micrometer (μm) to about 100 μm. Such a spray wall generates a spray having a droplet size that is relatively uniform.

Document WO 2015/194962 describes several embodiments of a nozzle including a spray wall that is perforated with a plurality of spray holes, together with one or more filters arranged upstream from the spray wall.

A problem with that type of nozzle having micro-holes, and more particularly when it is fitted with one or more filters, is that it sometimes becomes blocked, such that spraying deteriorates progressively until it even becomes impossible. Initially, it was thought that the blocking or clogging of the nozzle was due to fine particles existing in suspension in the fluid, or resulting from manufacture, assembly, or operation of the dispenser member (pump). It was only after several series of tests that the cause of the blocking or clogging of the nozzle was discovered: it appears to result from the fluid drying out, or from the viscosity of the fluid increasing significantly at the nozzle itself. Thus, solid or paste residues form in the nozzle and clog the spray wall and/or the filter(s), leading to the spray deteriorating, or even stopping.

In order to solve the problem of nozzles having micro-holes blocking or clogging, and in particular when they are fitted with filters, the present invention proposes that the head includes a suction chamber of volume that is variable, such that the volume of the suction chamber decreases when pressure is exerted on the bearing surface and increases when the pressure on the bearing surface is relaxed. Thus, the suction chamber generates suction or "sniffing" that makes it possible to remove the fluid from the spray wall and/or from the filter(s) by returning the fluid into the suction chamber. To do this, it suffices to adapt the variation in the volume of the suction chamber to the volume defined by the spray wall alone or to the volume from the spray wall up to the filter that is the furthest upstream.

Advantageously, the spray holes present a diameter lying in the range about 1 μm to about 100 μm, advantageously in the range about 5 μm to about 30 μm, and preferably in the range about 10 μm to about 20 μm.

In an advantageous embodiment, the dispenser head further includes at least one filter upstream from the spray wall. The filter may be in the form of a filter plate including filter holes that are more numerous than the spray holes, but presenting a diameter that is smaller than the diameter(s) of the spray holes. The filter may also be in the form of a filter block forming a network of open cavities. A single spray nozzle may include both one or more filter plates and also one or more filter blocks.

When there is no filter, the variation in the volume of the suction chamber is greater than the combined volumes of the spray holes. Otherwise, when an intermediate space is formed between the spray wall and a filter, the variation in the volume of the suction chamber is greater than the combined volumes of the spray holes, of the intermediate space, and of the filter holes, and/or of the network of open cavities.

In a practical embodiment, the suction chamber may include a piston or an elastically-deformable wall.

The dispenser head may be in the form of a pusher, comprising:

- a connection sleeve for connecting to an outlet of a dispenser member, such as a pump or a valve;
- an inlet well in line with the connection sleeve;
- an axial assembly housing;
- a feed duct that connects the inlet well to the axial assembly housing; and
- a nozzle that is engaged in the axial assembly housing, the spray wall being secured to the nozzle;
- wherein the suction chamber is formed between the connection sleeve and the inlet well or between the inlet well and the feed duct.

The spirit of the invention resides in emptying the multiple-hole nozzle of the fluid that it contains after a stage of spraying. The suction chamber incorporated in the pusher serves to create suction just after the spraying stage, thereby causing the fluid contained in the nozzle to be sucked out and stored in the suction chamber until the next spraying stage. It is thus guaranteed that the spray nozzle is empty of any fluid, such that there is no longer any risk of blocking or clogging by drying, or of solid residues forming, or of increase in viscosity.

The invention is described more fully below with reference to the accompanying drawings, which show several embodiments of the invention as non-limiting examples.

Figure 2B:
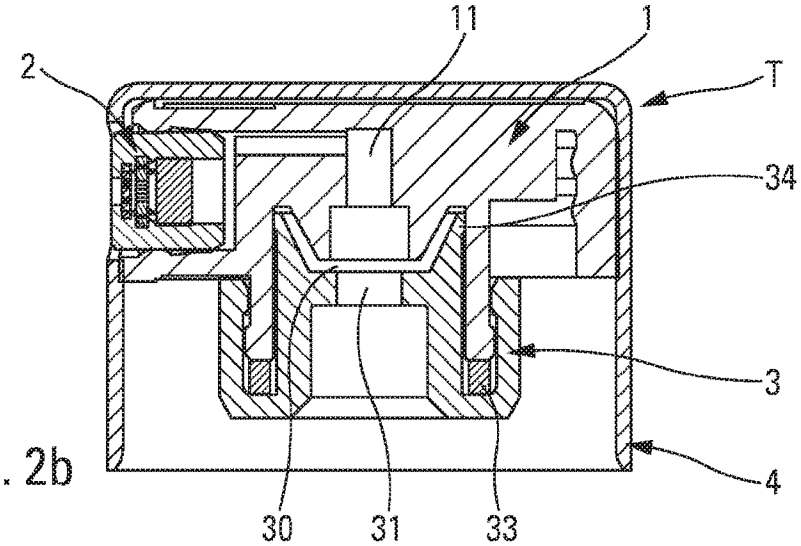
Figure 1:
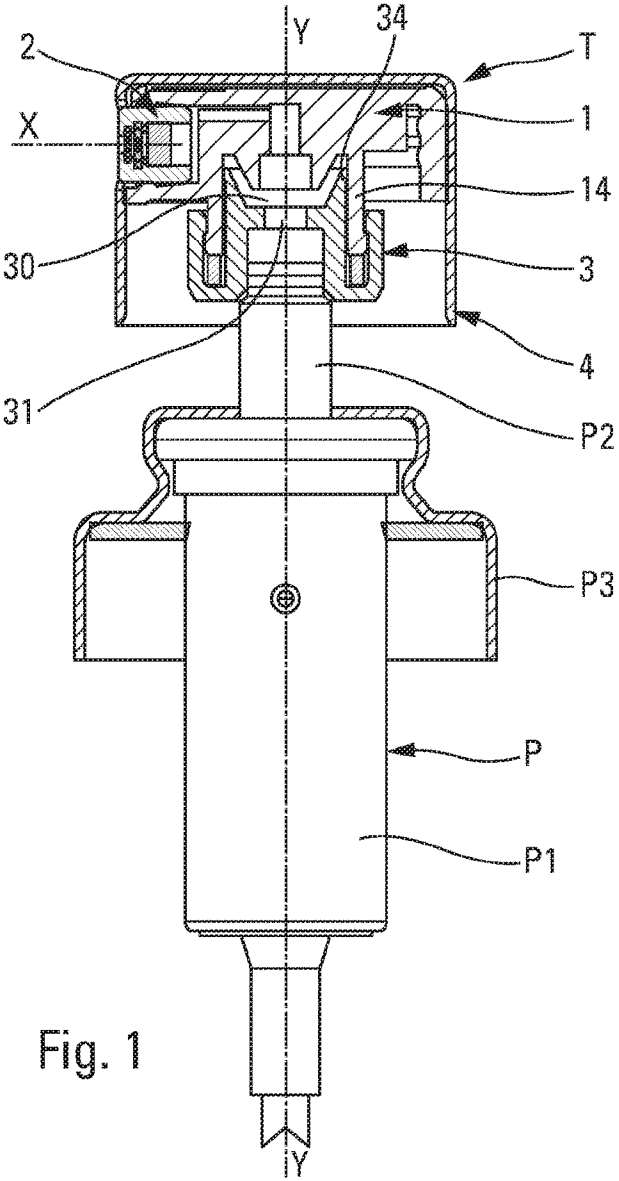
Figure 3A:
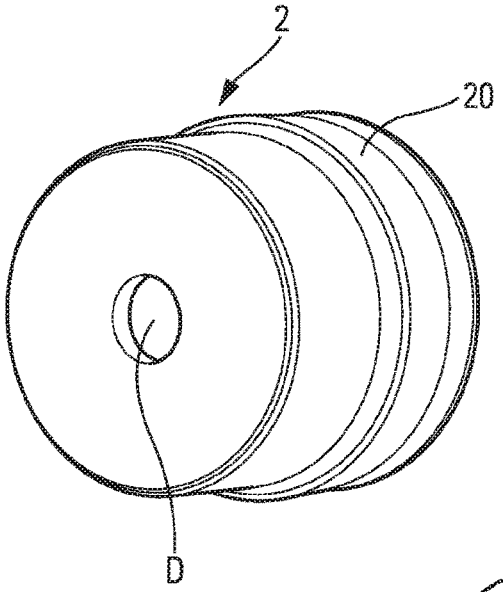
Figure 3B:
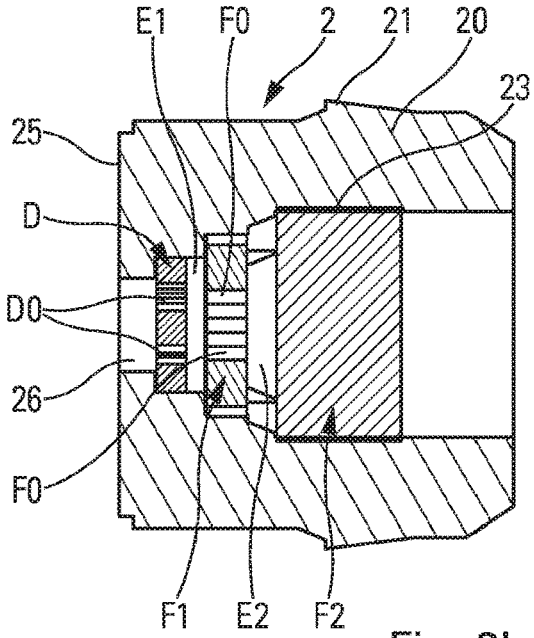
Figure 3C:
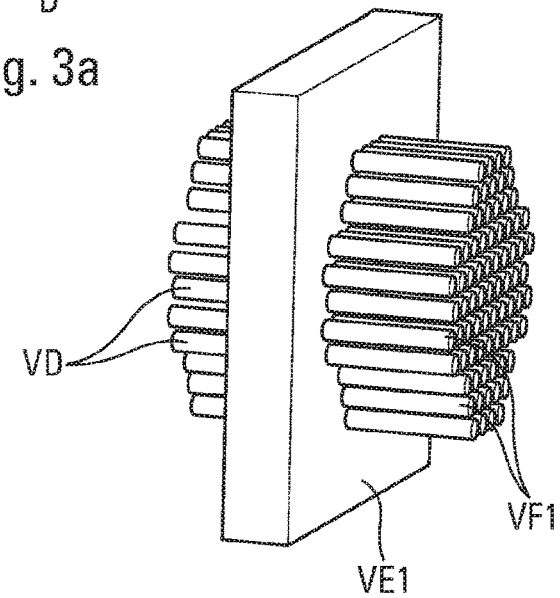

In the figures:

FIG. 1 is a vertical section view through a pump fitted with a dispenser head that incorporates a suction chamber in a first embodiment of the invention;

FIG. 2*a* is a larger-scale view of the FIG. 1 dispenser head at rest;

FIG. 2*b* is a larger-scale view of the FIG. 2 dispenser when actuated;

FIGS. 3*a* and 3*b* are views, respectively in perspective and in cross-section, of the nozzle in the above-mentioned figures;

FIG. 3*c* shows the volume of fluid present in the nozzle in FIGS. 3*a* and 3*b;*

Figure 4A:
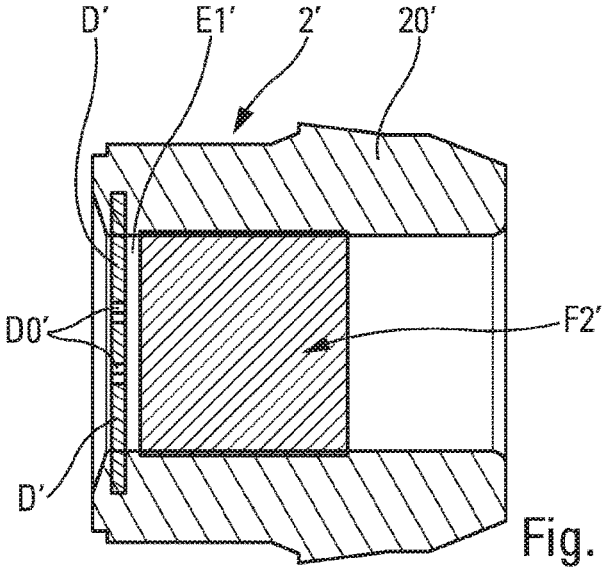
Figure 4B:
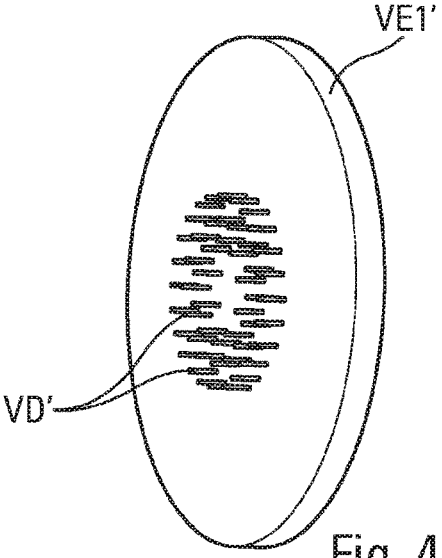
Figure 6A:
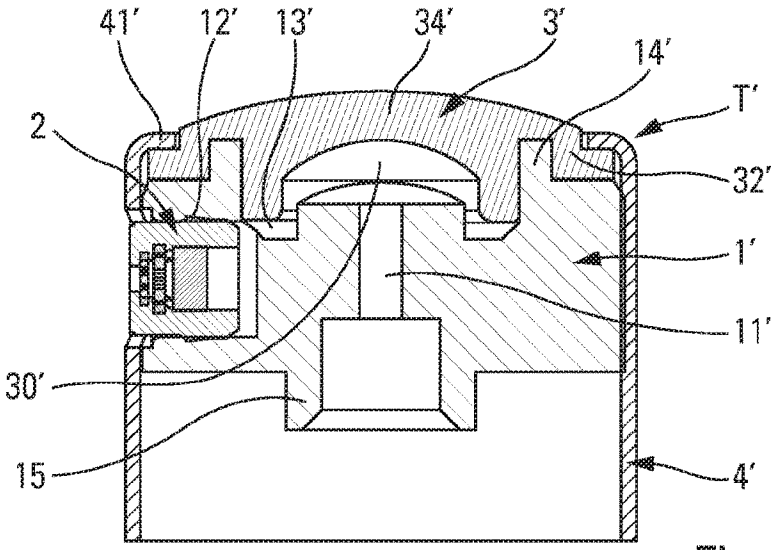
Figure 6B:
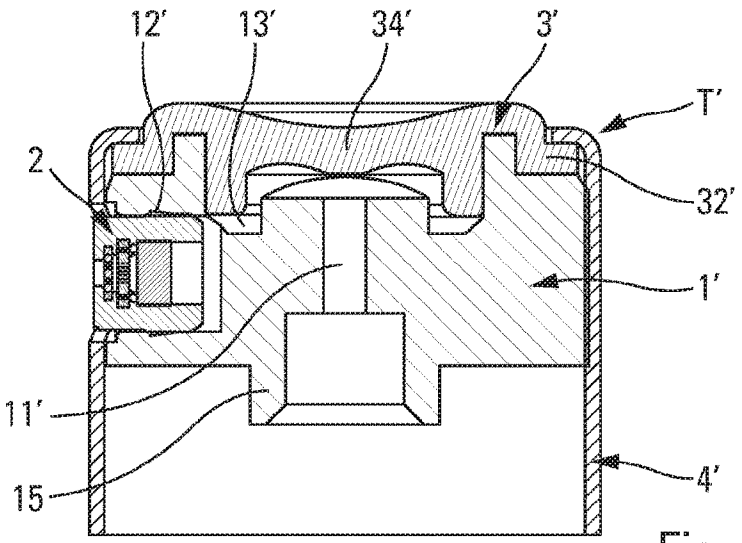
Figure 5:
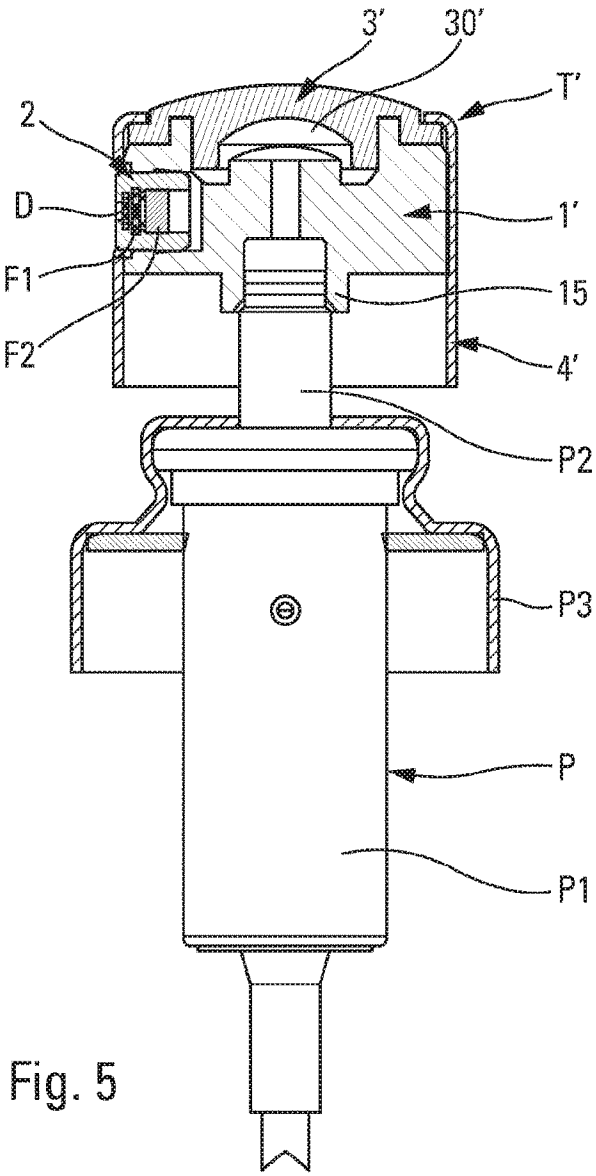

FIGS. 4*a* and 4*b* are views similar to FIGS. 3*b* and 3*c* respectively in a second embodiment of the nozzle of the invention; and FIGS. 5, 6*a*, and 6*b* are views similar to FIGS. 1, 2*a*, and 2*b* respectively in a second embodiment of the suction chamber of the invention.

Reference is made to FIGS. 1, 2*a*, and 2*b* taken together in order to describe the component parts of a dispenser head T made in accordance with the invention, and how they are arranged relative to one another.

The dispenser head T comprises three essential component parts, namely a head body 1, a nozzle 2, and a piston 3. The parts can be made by injection-molding plastics material. The head body 1 is preferably made as a single part: however, it could be made from a plurality of parts that are assembled together. The same applies for the nozzle 2 that may be made as a single part out of a single material, by overmolding, by bi-injecting a plurality of materials, or by mechanical assembly.

The head body 1 includes a substantially-cylindrical peripheral skirt 10 that is closed at its top end by a disk 16. The inside of the head body 1 defines an inlet well 11 that is open at its bottom end, and that is closed at its top end by the disk 16. The head body 1 also defines a feed duct 13 that connects the inlet well 11 to an assembly housing 12, as can be seen in FIGS. 1 and 3. The axial assembly housing 12 is of generally cylindrical configuration, thereby defining an inside wall that is substantially cylindrical. The feed duct 13 opens out into the assembly housing 2 in central manner. It should also be observed that the inside wall of the assembly housing 12 presents fastener profiles enabling the nozzle 2 to be held more securely. The head body 1 also defines a slide cylinder 14 that extends downwards in coaxial manner around the inlet well 11. The inside of the slide cylinder is cylindrical, and the outer wall of the slide cylinder presents a retention profile, e.g. in the form of a small outwardly-directed shoulder.

Optionally, the head body 1 may be engaged in a cover 4 that comprises a top bearing surface 41 on which a finger can press, and a side casing 42 that forms a side opening 43 through which the nozzle 2 can pass. In the absence of a cover 4, the bearing surface is formed by the disk 16 of the head body 1.

The nozzle 2 presents a configuration that is generally substantially conventional, in the form of a cup that is open at one end and closed at its opposite end by a spray wall D, advantageously in the form of a small plate, in which a plurality of spray holes or orifices DO are formed. With reference to FIGS. 3*a* and 3*b*, it can be seen that the nozzle 2 comprises a nozzle body 20 of shape that is generally substantially cylindrical and that is preferably axisymmetric. In other words, the nozzle 2 does not need to be oriented angularly, prior to being presented in front of the inlet of the axial assembly housing 12. The nozzle body 20 forms an outer assembly wall 21 that is advantageously provided with fastener portions in relief that are suitable for co-operating with the fastener profiles of the assembly housing 12. Thus, the nozzle 2 can be engaged axially without any particular orientation in the axial assembly housing 12. The inside of the nozzle body 20 forms a chamber that is defined by an inside wall 23 that forms a plurality of steps of decreasing diameter. On its outer front face, the nozzle body 20 forms a plane annular flat 25 that defines a central opening 26.

The spray wall D is secured to the nozzle body 20, advantageously occupying the central opening 26. The spray wall D is fastened to the nozzle body 20 by any means, such as by overmolding, by bi-injection, by molding as a single part made of a single material, by snap-fastening, by crimping, by rolling, by force-fitting, etc.

The spray wall D may be a single-piece plate made of a single material, an assembly of a plurality of parts, or a multilayer structure, e.g. a laminate. It can be made of metal, plastics material, ceramic, glass, or a combination thereof. More generally, any material that is suitable for being perforated with small holes or orifices can be used. The thickness of the spray wall D where the holes DO are formed lies in the range about 1 μm to about 100 μm. The number of holes DO lies in the range about 20 to about 500. The diameter of the spray wall D where the holes DO are formed lies in the range about 0.5 millimeters (mm) to about 5 mm.

In an advantageous method of manufacture, the holes DO are perforated in the spray wall D while it is already secured to the nozzle body 20. Thus, the nozzle body 20 may be used as a holder for holding the spray wall D while it is being perforated, which may be done by laser, for example. It should be kept in mind that the spray wall D is a very small part, and as a result is difficult to handle. It should be observed that perforating the holes DO with the spray wall D pre-mounted on the nozzle body 20 is a method that may be implemented regardless of the size of the holes DO, i.e. regardless of the fact that the dispenser head incorporates a suction chamber.

Advantageously, the spray nozzle 2 also includes two filters F1 and F2 that are arranged upstream from the spray wall D.

The filter F1 is mounted on a step of the inside wall 23, behind the spray wall D, defining between them a first intermediate space E1. The filter F1 is a plate that is substantially similar to the spray wall D, with filter holes FO that are advantageously more numerous than the spray holes DO, but that advantageously present a diameter that is smaller than the diameter(s) of the spray holes DO. It should also be observed that the diameter of the filter plate F1 is greater than the diameter of the spray wall D. Its thickness may be substantially the same as the thickness of the spray wall D, or a little greater.

The filter F2 is also mounted on a step of the inside wall 23, upstream from the filter F1, defining between them a second intermediate space E2. The filter F2 is in the form of a block of porous material that is advantageously rigid, such as Porex®, and that forms a network of open cavities having an average pore size that may lie in the range about 7 μm to about 100 μm.

Thus, by pressing on the dispenser head T, fluid delivered by the pump P flows through the inlet well 11 and the feed duct 13, passes through the filter F2, fills the second intermediate space E2, passes through the filter F1, fills the first intermediate space E1, and finally passes through the spray wall D, at the outlet of which it is sprayed in small droplets. FIG. 3*c* shows the volumes of the fluid: in the filter F1, namely VF1; in the first intermediate space E1, namely VE1; and in the spray wall D, namely VD.

FIG. 4*a* shows a second embodiment of a spray nozzle 2' that may be used in the dispenser head T instead of the spray nozzle 2. The spray nozzle 2' includes a spray wall D' on which the nozzle body 20' has been overmolded. The spray wall D' also defines a series of small spray holes DO' of diameter lying in the range about 1 μm to about 100 μm. The nozzle 2' includes only one filter F2' that may be substantially identical to the filter F2, i.e. formed by a piece or a block of porous material that is advantageously rigid, such as Porex®, and that forms a network of open cavities having an average pore size that may lie in the range about 7 μm to about 100 μm. The filter F2' and the spray wall D' define between them an intermediate space E1'. FIG. 4*b* is similar to FIG. 5*c* and shows the volumes of the fluid: in the intermediate space E1', namely VE1'; and in the spray wall D', namely VD'.

In the invention, the dispenser head T incorporates a suction chamber 30 that is formed by the head body 1 co-operating with the piston 3. With reference to FIGS. 2*a* and 2*b*, it can be seen that the piston 3 is mounted to slide around the slide cylinder 14 against a spring 33, which may be an elastically-deformable ring. The piston 3 is thus urged away from the inlet well 11 while remaining secured to the slide cylinder 14 by means of the retention profile of the cylinder 14 that co-operates with a ring 32 of the piston 3 that is engaged around the cylinder 14. In FIG. 2*a*, the piston 3 is at rest, and in FIG. 2*b*, the piston 3 has moved as far as possible towards the inlet well 11, compressing the spring 33. The piston also includes a sleeve 35 that is engaged in the slide cylinder 14, being connected at its bottom end to the ring 32, and forming at its free top end a piston lip 34 that is in leaktight sliding contact with the cylindrical inside wall of the slide cylinder 14. The sleeve 35 also defines a central passage 31. The piston 3 and the head body 1 define between them the suction chamber 30 having a volume that varies with the sliding movement of the piston 3.

With reference once again to FIG. 1, it can be seen that the sleeve 35 is connected to the free end of an actuator rod P2 of a dispenser member P, such as a pump or a valve. The actuator rod P2 is movable downwards and upwards along the axis Y, against an internal spring (not shown). Preferably, the stiffness of the spring 33 of the piston 3 is less than the stiffness of the internal spring of the dispenser member P. The actuator rod P2 is hollow so as to define a flow duct that is in communication with a metering chamber of the dispenser member P. The central passage 31 of the piston 3 is situated directly downstream from the outlet of the actuator rod P2, so that fluid delivered by the dispenser member P passes through the suction chamber 30 in order to reach the inlet well 11.

When the dispenser head T is at rest (FIG. 2*a*), the suction chamber 30 presents a maximum volume. When a user presses on the bearing surface of the head T, the suction chamber 30 decreases in volume until it reaches its minimum volume (FIG. 2*b*). Then, the actuator rod P2 moves so as to dispense fluid through the head T and its spray nozzle 2 from where it is to be sprayed. When the user relaxes the pressure on the bearing surface of the head T, the actuator rod P2 returns to its rest position under the action of the internal spring. The piston 3 also moves so that it too returns to its rest position (FIG. 2*a*). In this way, suction is created in the suction chamber as a result of its increase in volume. This suction generates a suction force at the nozzle 2 that moves the fluid that it contains towards the suction chamber 30. In this way, it is possible to empty the spray holes DO, the filters F1, F2, F2', and the intermediate spaces E1, E2, E1'. The variation in the volume of the suction chamber 30 can be adapted to the design of the nozzle, so as to remove a sufficient volume of fluid. In the nozzle 1, it is possible for example to empty out the spray holes DO, the first intermediate space E1, and the filter holes FO, but not the second intermediate space E2, nor the filter F2. Thus, only the volume shown in FIG. 3*c* would be emptied out.

FIGS. 5, 6*a*, and 6*b* show a second embodiment of the suction chamber. A flexible dome 3' is mounted on the head body 1' in place of the plate 16 of the first embodiment. The flexible dome 3' includes an anchor collar 32' that is mounted on a fastener flange 14' of the head body 1'. In addition, the cover 4' forms an inwardly-directed rim 41' that comes to press the anchor collar 32' against the head body 1'. Thus, the anchor collar 32' is mounted in stationary and leaktight manner on the head body 1'. The flexible dome 3' also includes an elastically-deformable actuator wall 34' that forms a bearing surface for a user's finger. The suction chamber 30' is thus formed between the head body 1' and the elastically-deformable actuator wall 34'. It is fed with fluid via the inlet well 11', and the outlet of the chamber is formed by the feed duct 13' that is connected to the nozzle 2.

By pressing the elastically-deformable actuator wall 34', as shown in FIG. 6*b*, the volume of the actuator rod P2 is reduced, and then the actuator rod P2 of the dispenser member P is moved. Fluid is then delivered through the actuator rod P2: it passes through the inlet well, the suction chamber 30', the feed duct 13', and the nozzle 2, from where it leaves, sprayed in small droplets. When the user relaxes the pressure on the actuator wall 34', the actuator rod P2 returns to its rest position, and the actuator wall 34' also returns to its rest position. The suction created in this way in the suction chamber 30' is used advantageously to empty or to evacuate the spray nozzle 2 of its fluid, as in the first embodiment.

It is clear that the nozzle 2' in FIGS. 4*a* and 4*b* may be mounted instead of the nozzle 2 in the second embodiment of the suction chamber 30'.

The present invention thus relies on the combination of a suction chamber with a nozzle having multiple micro-holes (20 to 500 1 μm to 100 μm holes), advantageously fitted with one or more filters.

The invention claimed is:

1. A fluid dispenser head for mounting on a dispenser member and including a bearing surface for actuating the dispenser member and dispensing the fluid, and a spray wall that is perforated with a network of spray holes through which the fluid under pressure passes so as to be sprayed in small droplets;

the dispenser head further includes a suction chamber of volume that is variable, such that the volume of the suction chamber decreases when pressure is exerted on the bearing surface and increases when the pressure on the bearing surface is relaxed, and such that fluid present between the spray wall and the suction chamber is sucked back into the suction chamber when the pressure on the bearing surface is relaxed.

2. A dispenser head according to claim 1, wherein the spray holes present a diameter lying in the range about 1 μm to about 100 μm.

3. A dispenser head according to claim 1, wherein the spray holes present a diameter lying in the range of about 5 μm to about 30 μm.

4. A dispenser head according to claim 1, further including at least one filter upstream from the spray wall.

5. A dispenser head according to claim 4, wherein the filter is a filter plate including filter holes that are more numerous than the spray holes, but presenting a diameter that is smaller than a diameter of the spray holes.

6. A dispenser head according to claim 4, wherein the filter is a filter block forming a network of open cavities.

7. A dispenser head according to claim 6, wherein, when an intermediate space is formed between the spray wall and the filter, the variation in the volume of the suction chamber is greater than combined volumes of the spray holes, of the intermediate space, and of the filter holes, and/or of the network of open cavities.

8. A dispenser head according to claim 1, wherein the variation in the volume of the suction chamber is greater than the combined volumes of the spray holes.

9. A dispenser head according to claim 1, wherein the suction chamber includes a piston or a flexible dome.

10. A dispenser head according to claim 1, said dispenser head being in the form of a pusher, comprising:

a connection sleeve for connecting to an outlet of the dispenser member;

an inlet well in line with the connection sleeve;

an axial assembly housing;

a feed duct that connects the inlet well to the axial assembly housing; and a nozzle that is engaged in the axial assembly housing, the spray wall being secured to the nozzle;

wherein the suction chamber is formed between the connection sleeve and the inlet well or between the inlet well and the feed duct.

11. The dispenser head according to claim 1, wherein the dispenser member is a pump.

12. The dispenser head according to claim 1, wherein the spray holes present a diameter lying in the range of about 10 μm to about 20 μm.

* * * * *